United States Patent [19]

Im

[11] Patent Number: 4,902,260

[45] Date of Patent: Feb. 20, 1990

[54] AMPHIBIAN TOY CAR

[75] Inventor: Tae-Kyu Im, Seoul, Rep. of Korea

[73] Assignee: Bando Sports, Ltd., Buchan, Rep. of Korea

[21] Appl. No.: 291,102

[22] Filed: Dec. 28, 1988

[30] Foreign Application Priority Data

Mar. 8, 1988 [KR] Rep. of Korea ..... 1988-2386

[51] Int. Cl.[4] ..... A63H 23/04

[52] U.S. Cl. ..... 446/154; 446/164; 446/460

[58] Field of Search ..... 446/154, 160, 162, 163, 446/164, 165, 460, 456, 437, 468, 463

[56] References Cited

U.S. PATENT DOCUMENTS

| | | | |
|---|---|---|---|
| 340,655 | 4/1886 | Bogner | 446/164 |
| 3,386,406 | 6/1968 | Tsunoda | 446/460 X |
| 3,600,847 | 8/1971 | Lakin | 446/164 |
| 4,270,307 | 6/1981 | Arigaya | 446/456 X |
| 4,652,247 | 3/1987 | Goldfarb et al. | 446/164 |
| 4,744,781 | 5/1988 | Ostendorff et al. | 446/164 |

*Primary Examiner*—Mickey Yu

*Attorney, Agent, or Firm*—Marmorek Guttman, & Rubenstein

[57] ABSTRACT

Am amphibian toy car which can be operated by a remote controller comprising a semicircular flow-control cover disposed ajacent to the upper portion of each front wheel and a buoy. By these flow-control cover and buoy, the forward propel force above the front wheels is not generated, so that the toy car can move forwardly and turn right and left under the condition that wheels are submerged in water.

5 Claims, 5 Drawing Sheets

FIG. 5a
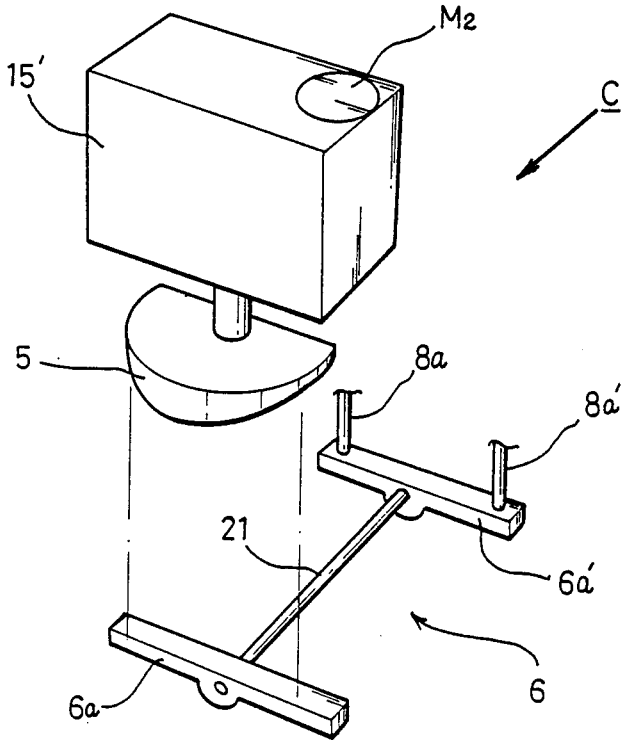
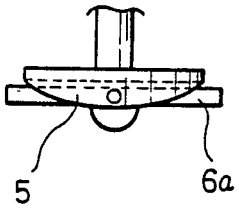
FIG.5b
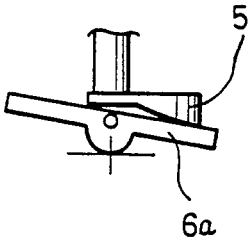
FIG.5c
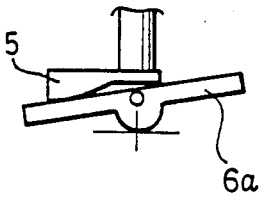
FIG.5d

AMPHIBIAN TOY CAR

BACKGROUND OF THE INVENTION

1. Field of the Invention

The present invention relates to an amphibian toy car operable by a remote control.

2. Description of Prior Arts

Conventional amphibian toy cars could not obtain a propel force under the condition that whole wheels are submerged in water. This is because when wheels rotate as shown in FIG. 7, the pushed direction of the water disposed below wheels is opposite to that of the water disposed above wheels, thereby causing the generated propel forces to be cancelled. As a result, the toy car can not move forwardly. Therefore, amphibian toy cars of which wheels are partially submerged in water has been proposed. However, such toy car has a malformed shape in which wheels and car body are unbalanced. As a result, children and consumers did not take an interest in such toy cars.

SUMMARY OF THE INVENTION

Therefore, the object of the present invention is to eliminate the above-mentioned disadvantages encountered in the prior arts and to provide an amphibian toy car which can move forwardly and turn right and left, under the condition that wheels are fully submerged in water.

In accordance with the present invention, the object can be accomplished by providing an amphibian toy car which can be operated by a remote controller comprising: a car body including upper and lower car bodies; front and rear wheels rotatably mounted on said lower car body; an annular buoy mounted on the connection between said upper and lower car bodies, said buoy being provided with seal rings; a wheel driving unit disposed in the interior of the car bodies, said wheel driving unit including a steering device, a main drive motor, and a differential device; said steering device including a tapered sliding cam and I-shaped steering lever operatively connected to said sliding cam, said steering lever having a pair of operating arms; said differential device including a drive gear connected to said main drive motor, a pair of steering gears engaged with said drive gear, a pair of intermediate gears each engaged with each of said steering gears, and a pair of driven gears each engaged with each of said intermediate gears; and a pair of sliding shaft each carrying each steering gear, sid shaft being operatively connected to said operating arms of steering lever and being always exerted by a spring in the direction that the steering gear is engaged with the corresponding intermediate gear, so that the forward movement and right and left turning of said toy car can be carried out, as desired, under the condition that wheels are fully submerged in water.

BRIEF DESCRIPTION OF THE DRAWINGS

Hereinafter, the present invention will be more apparent from the following description taken in conjunction with the drawings.

FIG. 5(*a*) is an disassembled perspective view of a steering device operatively connected to a transmission device;

FIGS. 5(*b*) to 5(*d*) are views showing different operations of a sliding cam and I-shaped steering lever;

DETAILED DESCRIPTION OF THE PREFERRED EMBODIMENTS

Figure 1:
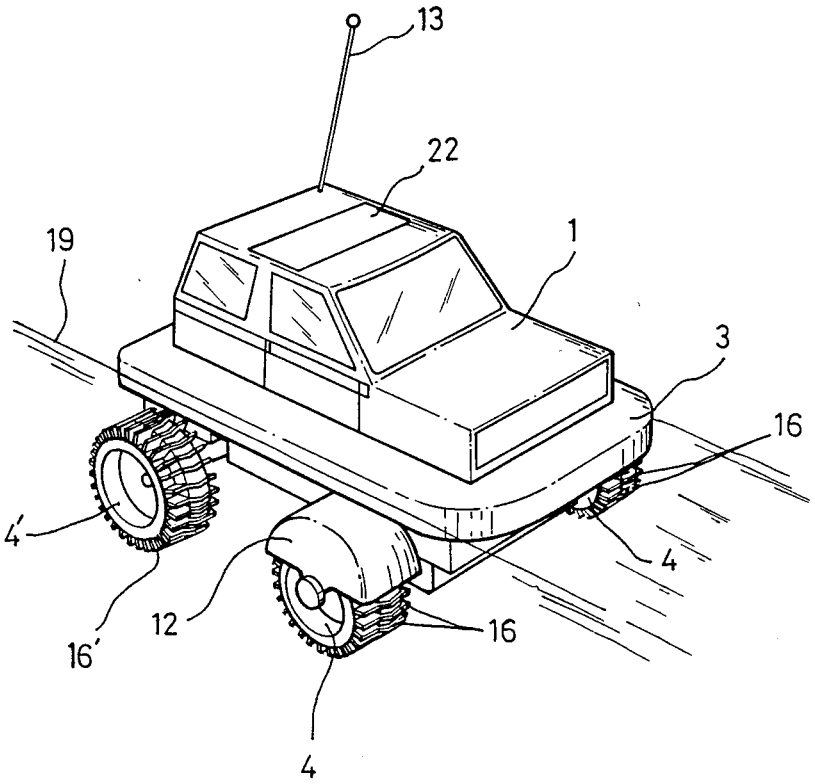
FIG. 1 is a perspective view of an amphibian toy car in accordance with the present invention.
Figure 2:
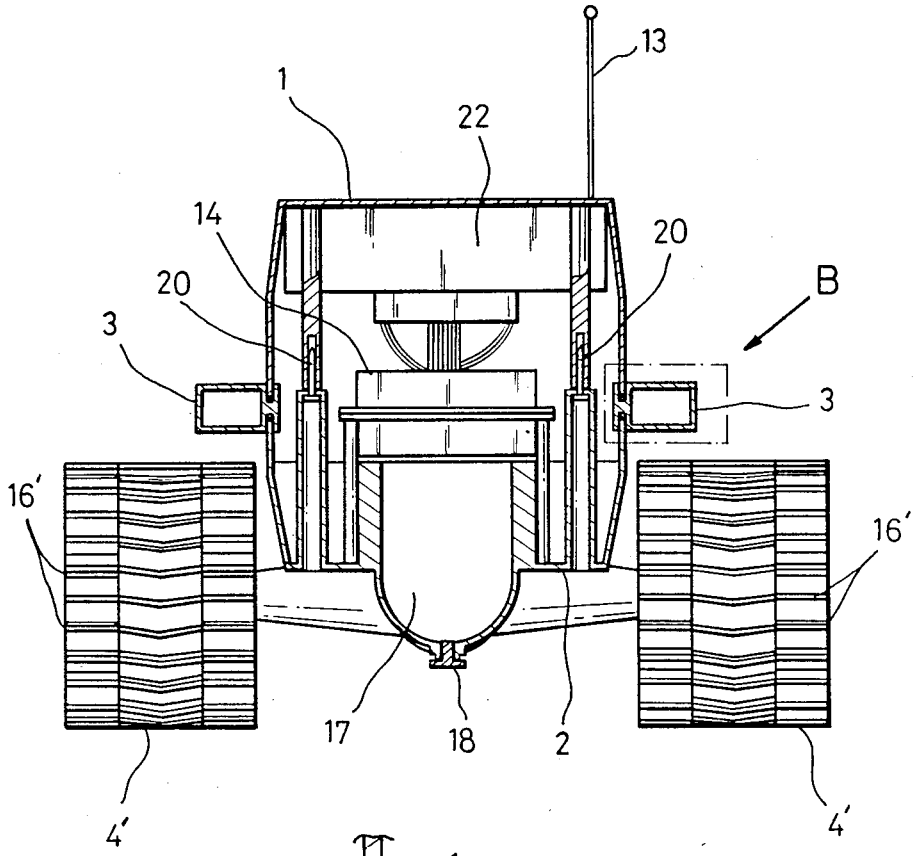
FIG. 2 is a cross-sectional view taken from FIG. 1.

Referring to drawings, there is shown an amphibian toy car according to the present invention which can be operated by a remote controller. The amphibian toy car comprises an upper car body 1, a lower car body 2, an annular buoy 3 interposed between said two car bodies 1 and 2, and front and rear wheels 4 and 4'. A seal ring **3*a* is located between the buoy 3 and each car body, in order to provide a seal between two car bodies. In accordance with the present invention, when the toy car passes water, only lower car body 2 and front and rear wheels 4 and 4' are submerged in water by means of the annular buoy 3**.

A wheel driving unit is disposed in the interior of the car bodies 1 and 2. The wheel driving unit comprises a steering device C including a tapered semi-circular sliding cam 5 and I-shaped steering lever 6 with operating arms **6*a* and 6*a'*, a main drive motor $M_1$, and a differential device D. The differential device D includes a drive gear 7 connected to the main drive motor $M_1$ via a reduction gear drive 15, a pair of steering gears 8 and 8' disposed at and engaged with both sides of said drive gear 7 with each spring 9 and 9', respectively, a pair of intermediate gears 10 and 10' each engaged with each of said steering gear 8 and 8', and a pair of driven gears 11 and 11' each engaged with each of said intermediate gears 10 and 10'. Steering gears 8 and 8' are fixedly mounted on sliding shaft 8*a* and 8*a'*, respectively. Depending on a sliding movement of each sliding shaft 8*a* (or 8*a'*), the corresponding steering gear 8 (or 8') can be selectively disengaged from the intermediate gear 10(or 10'). Each sliding shaft 8*a*(or 8*a'*) is always exerted by a spring 9(or 9') in the direction that each steering gear 8 (or 8') is engaged with the corresponding intermediate gear 10 (or 10'). The sliding shaft 8*a* and 8*a'* of the steering gears 8 and 8' in the differential device D are operatively connected to the operating arm 6*a'* of the steering lever 6 in the steering device C so that the forward movement and right and left turning of the toy car can be carried out, as desired, under the condition that wheels 4 and 4' are submerged in water. In order to move the toy car under the condition that wheels are submerged in water, a semi-circular flow-control cover 12 is attached adjacent to the upper portion of each front wheel 4**, in accordance with the present invention.

In the drawings, reference numeral 19 designates the water level, 20 a fixing screw, 21 a connecting rod, and 22 a dry battery box.

Now, the operation of the amphibian toy car of the present invention will be described in detail.

As an operator manipulates a forward-moving switch by using a remote controller under the condition that the toy car is submerged in water, a forward-moving signal is generated and received into a control device 14 via antennas 13. Then, the control device 14 actuates the main drive motor $M_1$. The driving force is transmitted to the drive gear 7 via the reduction device 15, so that the drive gear 7 rotates at a certain rate.

As the drive gear 7 rotates, both steering gears 8 and 8' engaged with the drive gear 7 rotate, so that the intermediate gears 10 and 10' and the driven gears 11 and 11' rotate, thereby causing the rotating force to be transmitted to both front wheels 4. Thus, the toy car moves forwardly by the rotation of the front wheels.

Figure 7:
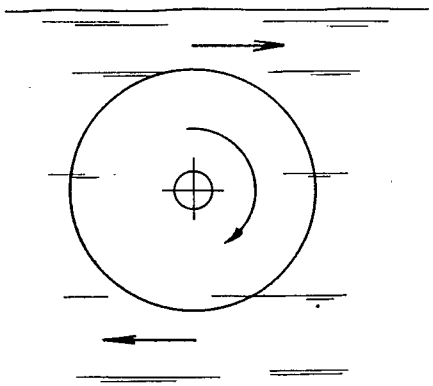
FIG. 7 is a view showing a moment generated in wheels provided with no flow-control cover.
Figure 6:
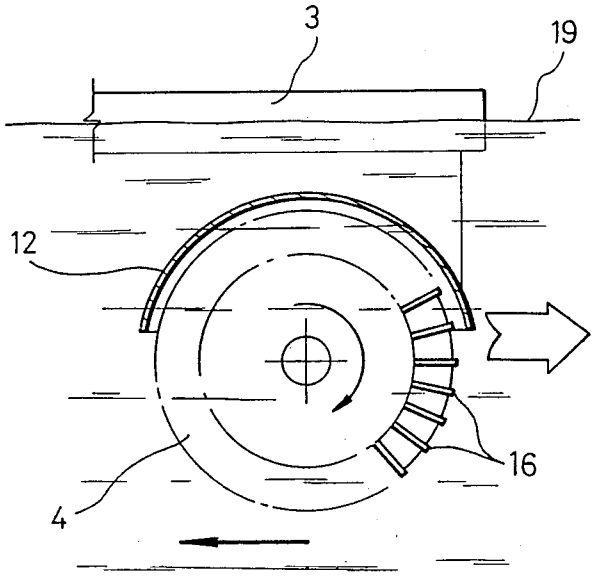
FIG. 6 is a view showing a propel condition of front wheels.

A plurality of propel vanes 16 are formed around the periphery of each front wheel 4, in accordance with the present invention. Accordingly, when wheels rotate in clockwise as shown in FIG. 6, the propel vanes 16 push water backwardly, thereby causing the toy car to move forwardly. If wheels with no flow-control rotate under the condition of FIG. 7, water-pushing forces which are generated above and below each wheel 4, respectively, are cancel each other so that the toy car can not move forwardly, even though the wheels rotate. However, if the semicircular flow-control cover 12 is disposed closely the upper portion of each front wheel 4, the upper force pushing water forwardly will be eliminated. Accordingly, only the force pushing water backwardly is effectively exerted, so that the toy car can move forwardly. No drive power is transmitted to rear wheels 4'. However, the rear wheels 4' are freely rotatable and provided with a plurality of vanes 16' as in the case of the front wheels. Thus, the toy car of the present invention can be not only similarly operated on a land as in general toy cars, but also smoothly rolled over rocks slightly protruded from the water level when the toy car is submerged in water.

When a right-turning signal is generated in order to turn the toy car in a right direction, the stepping motor $M_2$ shown in FIG. 5 rotates in a desired direction so that the sliding cam 5 which has been positioned at the position of FIG. 5(*b*) can turn to the position in which the cam 5 pushes down the right portion (in the drawing) of the operating arm 6*a* of the steering lever 6, as shown in FIG. 5(*c*). As a result, the sliding shaft 8*a* is pushed up against the force of the spring 9, thereby causing the steering gear 8 to be disengaged from the intermediate gear 10. Accordingly, the drive force of the drive gear 7 is not transmitted to the right front wheel, but transmitted only to the left front wheel, so that the toy car turns right.

On the other hand, when a left-turning signal is generated in order to turn the toy car in a left direction, the stepping motor $M_2$ rotates in a direction opposite to that in the above-mentioned right-turning case so that the sliding cam 5 pushes down the left portion of the operating arm 6*a* of the steering lever 6 as shown in FIG. 5(*d*). As a result, the sliding shaft 8*a'* is pushed up against the force of the spring 9', thereby causing the steering gear 8' to be disengaged from the intermediate gear 10'. Accordingly, the drive force of the drive gear 7 is not transmitted to the left front wheel, but transmitted only to the right front wheel so that the toy car turns left.

When a forward-moving signal is generated at the above condition, the sliding cam 5 returns to the neutral position of FIG. 5(*b*). Accordingly, both steering gears 8 and 8' are engaged with the intermediate gears 10 and 10', respectively, so that the drive force of the drive gear 7 is transmitted to both front wheels 4, thereby causing the toy car to move forwardly.

Figure 3:
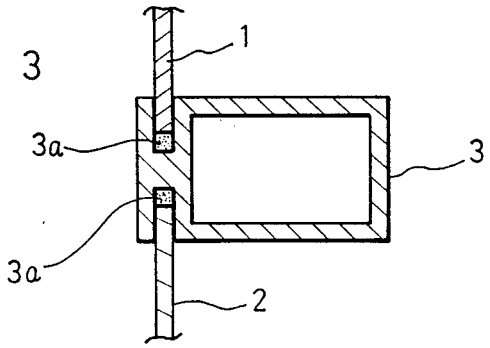
FIG. 3 is an enlarged view of the section B of FIG. 2.
Figure 4:
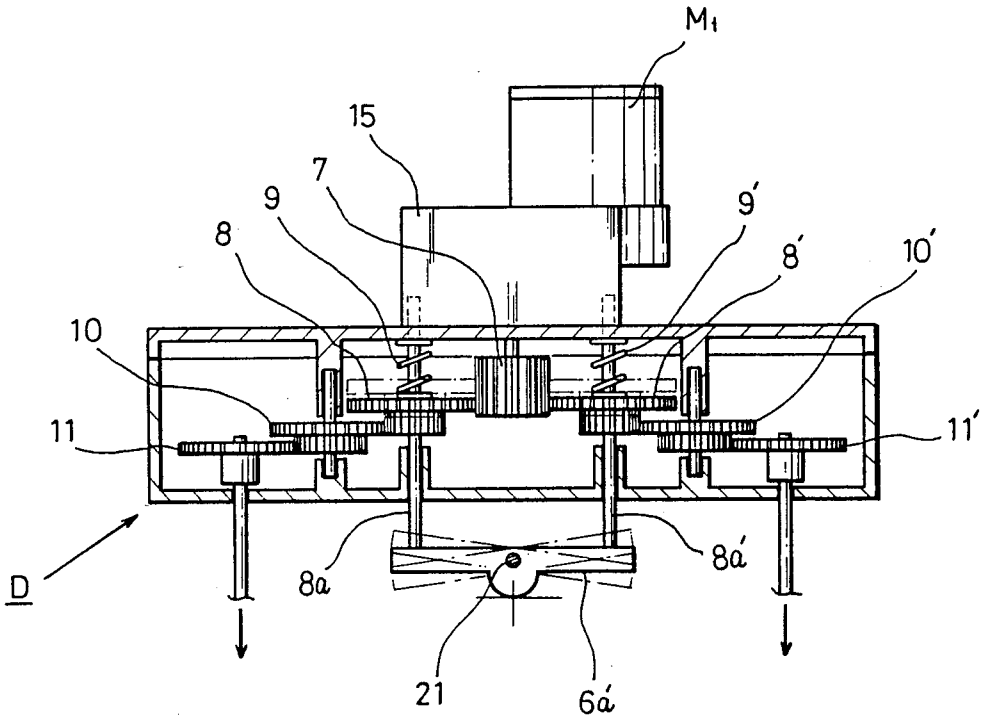
FIG. 4 is a sectional view of a differential device connected to front wheels.

As above-mentioned, the present invention provides a buoy 3 at the connection between upper and lower car bodies 1 and 2, as shown in FIG. 3. The buoy 3 functions to submerge the toy car in water to a certain depth.

In accordance with the present invention, a drain tank 17 is located on the bottom of the lower car body 2 in order to collect water which may be leaked into the interior of the car body. After playing with the toy car, a player opens a drain cock 18 of the drain tank 17 so that collected water can be drained.

As apparent from the above description, the present invention provides a semicircular flow-control cover 12 adjacent to the upper portion of each front wheel 4 so that wheels can move forwardly and turn right and left under the condition that wheels are fully submerged in water. Thus, the present invention provides a real amphibian toy car which can satisfy the children's mind.

The differential device is intermittently engaged with the steering gears 8 and 8', in accordance with the present invention. This construction of the present invention is simple, thereby providing a durable amphibian toy car with little trouble and low manufacturing cost.

What is claimed is:

1. An amphibian toy car which can be operated by a remote controller comprising:

a car body including upper and lower car bodies;

front and rear wheels rotatably mounted on said lower car body;

an annular buoy mounted on a connection between said upper and lower car bodies, said buoy being provided with seal rings;

a wheel driving unit disposed in the interior of the car bodies, said wheel driving unit including a steering device, a main drive motor, and a differential device;

said steering device including a tapered sliding cam and I-shaped steering lever operatively connected to said sliding cam, said steering lever having a pair of operating arms;

said differential device including a drive gear connected to said main drive motor, a pair of steering gears engaged with said drive gear, a pair of intermediate gears each engaged with one of said steering gears, and a pair of driven gears each engaged with one of said intermediate gears; and a pair of sliding shafts each carrying one of said steering gears, said shafts being operatively connected to one of said operating arms of said steering lever and being always exerted by a spring in the direction that each one of said steering gears is engaged with the corresponding intermediate gear, so that a forward movement and right and left turning of said toy car can be carried out, as desired, under the condition that wheels are fully submerged in water.

2. An amphibian toy car in accordance with claim 1, wherein a semicircular flow-control cover is mounted adjacent to the upper portion of each front wheel.

3. An amphibian toy car in accordance with claim 1, wherein a plurality of propel vanes are formed around the periphery of each wheel.

4. An amphibian toy car in accordance with claim 1, wherein a drain tank is disposed at the bottom of the lower car body.

5. Am amphibian toy car in accordance with claim 1, wherein said buoy mounted on the connection between said upper and lower car bodies functions to connect said upper and lower car bodies and to buoy the car body to a certain level.

* * * * *